United States Patent [19]

Vivian

[11] Patent Number: 4,846,459

[45] Date of Patent: Jul. 11, 1989

[54] EXERCISE MEASURING DEVICE

[76] Inventor: Keith Vivian, 61 Belloc Rd., Littlehampton, West Sussex, United Kingdom

[21] Appl. No.: 124,036

[22] Filed: Nov. 23, 1987

[30] Foreign Application Priority Data

Jan. 28, 1987 [GB] United Kingdom ..... 8701842

[51] Int. Cl.[4] ..... G01C 22/00

[52] U.S. Cl. ..... 272/70; 272/DIG. 5; 235/105; 377/24.2

[58] Field of Search ..... 272/70, DIG. 5, DIG. 6; 235/105, 95 C; 377/24.2

[56] References Cited

U.S. PATENT DOCUMENTS

| | | | |
|---|---|---|---|
| 765,992 | 7/1904 | Porter | 235/105 |
| 1,131,062 | 3/1915 | Jenkins | 235/105 |
| 1,209,382 | 12/1916 | Baumgaertner | 235/95 C |
| 1,340,036 | 5/1920 | Foss | 235/105 |
| 4,387,437 | 6/1983 | Lowrey et al. | 377/24.2 |
| 4,460,823 | 7/1984 | Ruehlemann | 235/105 |
| 4,563,574 | 1/1986 | Dreyer et al. | 235/95 C |

FOREIGN PATENT DOCUMENTS

| | | | |
|---|---|---|---|
| 285118 | 12/1913 | Fed. Rep. of Germany | 235/95 C |
| 3308431 | 9/1984 | Fed. Rep. of Germany | 235/105 |
| 0150236 | 11/1979 | Japan | 272/70 |
| 9101 | of 1908 | United Kingdom | 235/105 |
| 2192475 | 1/1988 | United Kingdom | 235/105 |

*Primary Examiner*—Richard J. Apley
*Assistant Examiner*—Franklin L. Gubernick
*Attorney, Agent, or Firm*—Lon H. Romanski

[57] ABSTRACT

There is described an exercise measuring device intended to be attached to a person's body or clothing to indicate that a predetermined level of activity is being maintained. In the form of the device shown a pendulum is mounted for movement between two adjustable stops so that movement of the person's body causes the pendulum to impact alternately on the stops. Electronic or electrical circuitry may be included to count the impacts on one or both stops, and audible or visible signals may be given when predetermined numbers of impacts have been registered.

12 Claims, 2 Drawing Sheets

EXERCISE MEASURING DEVICE

The present invention relates to excercise measuring devices, and particularly concerns a device which, when worn, indicates that a predetermined level of activity is being maintained.

According to the present invention, an exercise measuring device comprises pendulum means attached to a support which may be worn or fixed to a user's clothing, the support further including a pair of stops to limit the travel of the pendulum means along a predetermined path.

The device may form part of, or be attached to a belt worn, for example, round the user's waist, the device being positioned either centrally or at the side depending on the exercise movements to be performed.

Advantageously, the exercise measuring device includes means to give an audible or visible signal when the pendulum strikes one or other of the stops, and a counter may be incorporated to give an additional signal when a preset number of strikes has occured.

The stops may be adjustable to vary the extent of the travel of the pendulum means in accordance with the level of activity required by the user.

An embodiment of the invention will now be described, with reference to the accompanying drawings, in which.

Figure 1:
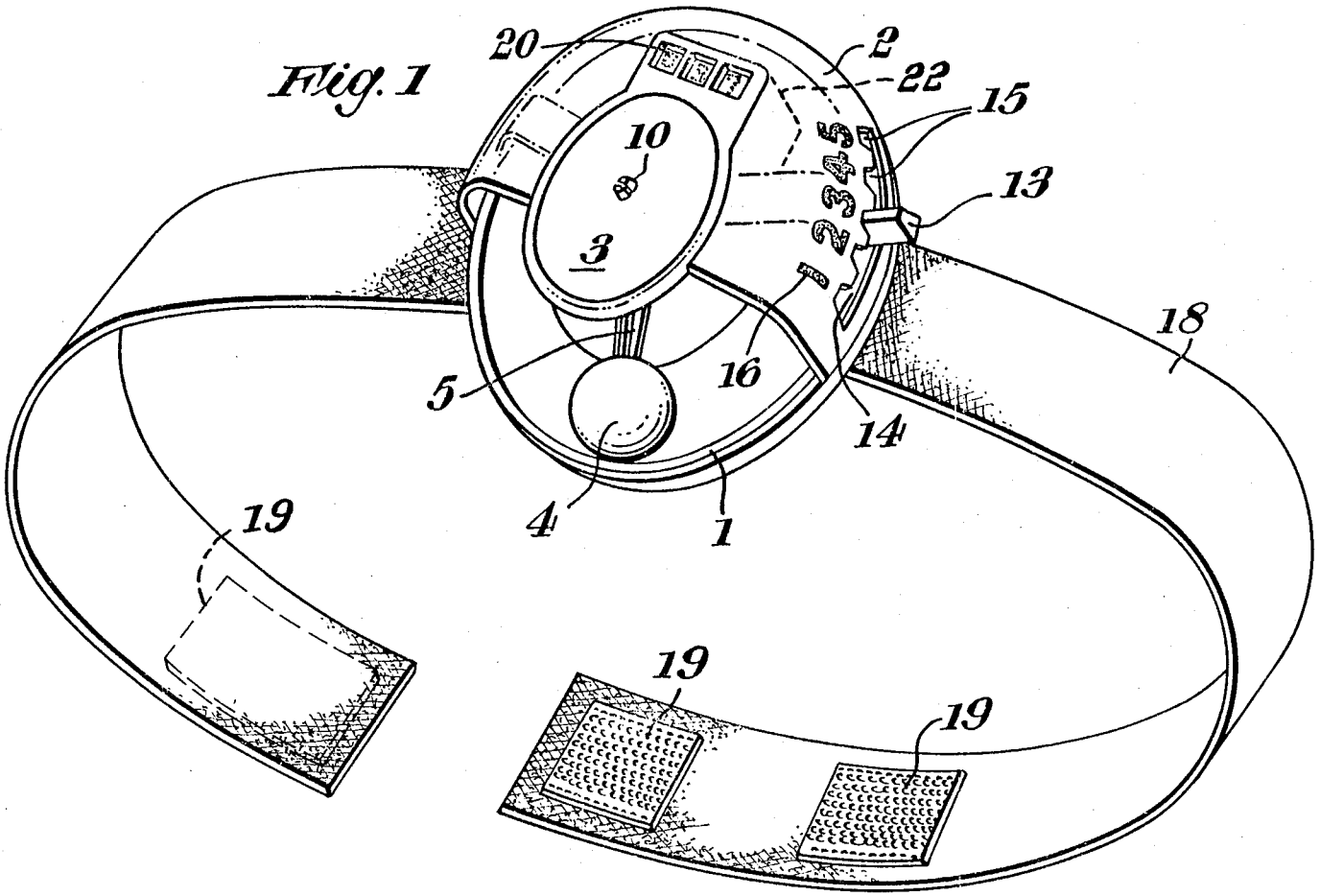
FIG. 1 is a perspective view of the exercise measuring device.
Figure 2:
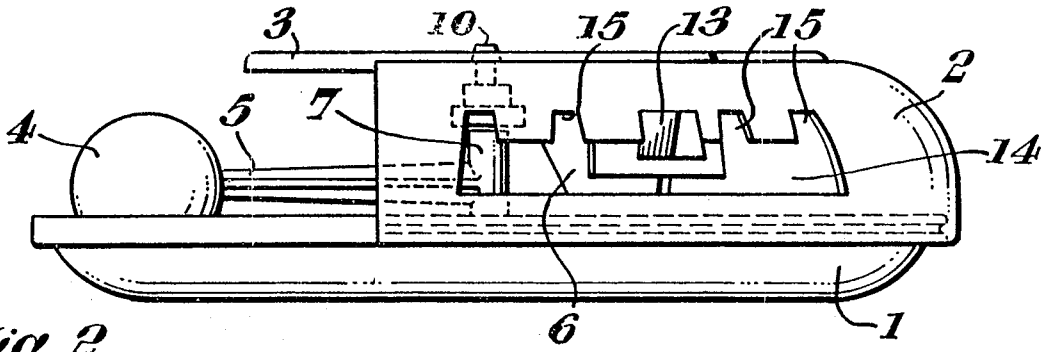
FIG. 2 is a side elevation of the device of FIG. 1.

Referring to FIG. 1, the device comprises a circular back plate 1 having a domed cover plate 2 over its upper part, the cover plate 2 including a central circular portion 3 spaced from the back plate 1 but parallel and coaxial therewith.

A pendulum bob 4 is mounted on one end of an arm 5, the other end of which is pivotally retained between the back plate 1 and the circular portion 3 of the cover plate 2, so that the pendulum bob 4 may perform arcuate movements parallel to the plane of the back plate 1.

Figure 3:
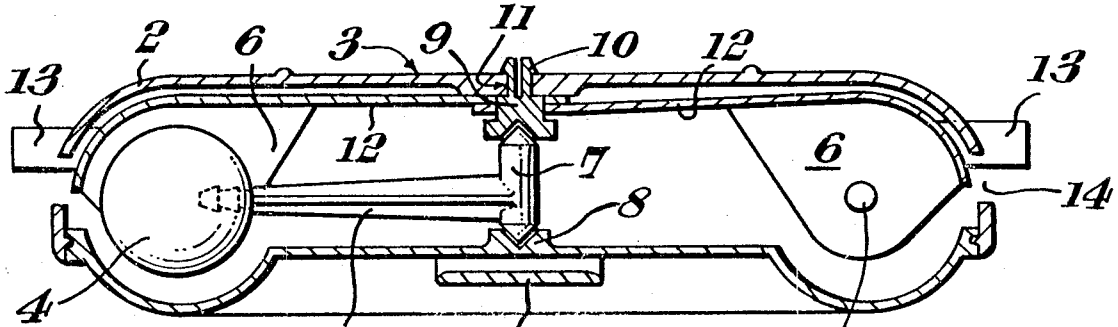
FIG. 3 is a horizontal central section of the exercise measuring device.

Between the cover plate 2 and the back plate 1 are provided two limit stops 6, best seen in FIG. 3. These stops 6 are positioned in the path of the pendulum bob 4, and are each adjustable to occupy one of a plurality of positions symmetrically arranged about the centreline of the device.

As is seen in FIG. 3, the arm 5 supporting the pendulum bob 4 is formed with a spindle 7 which is received in two bearing cups 8 and 9. Bearing cup 8 is formed on the back plate 1, and bearing cup 9 is formed in the end surface of a pin 10 which is snap-engaged into a central opening 11 of the circular portion 3 of cover plate 2.

The pin 10 serves as a mount for respective ends of a pair of resilient bars 12 which support the limit stops 6, the bars 12 being rotatable about the pin 10 and resiliently biased to urge their ends carrying limit stops 6 away from the back plate 1.

Extending from the bars 12 radially outwardly past limit stops 6 are adjustment lugs 13 which pass through slots 14 in the cover plate 2. The slots 14 are formed with recesses 15 in their edge remote from the back plate 1, the resilient action of the bars 12 urging the adjustment lugs into one of the recesses 15. Numerical indicia 16 are provided to identify the individual recesses 15.

On the rear face of back plate 1 is provided a clip 17 for attaching the device to a belt 18 or the like. The clip 17 may be a bar joined to the back plate at both its ends to form a loop, or may comprise a cantilever clip for attaching the device to a waistband of a garment. The device is shown in FIG. 1 attached to a belt provided with burr-type fastenings 19 for ease of adjustment.

The device is preferably constructed from moulded plastics components, it being possible to mould the bob 4, arm 5, and spindle 7 as a single component. Arm 5 may be rigid or resiliently flexible, or may be replaced by a cord or flexible monofilament. The cover plate 2 may be transparent, and the indicia 16 either painted, engraved or embossed thereon.

The device shown includes a digital display 20, which may be connected to sensors 21 mounted in the limit stops 6 and suitable circuitry, positioned as at 22, an area beneath the display 20, to count the impacts of the bob 4 on the limit stops 6. Many forms of electrical circuitry for performing such function are well known in the art and the invention is not limited to the use of any specific embodiment of such circuitry.

In use, the device is either worn on a belt around the user's waist or hips, or is suitably attached to the user's clothing in these areas by other means. Preferred positions of attachment are centrally at the front, or over the pelvic bones at the side. By suitable gyratory movement of the lower torso, the pendulum is caused to swing back and forth so that the bob 4 alternately contacts the stops 6. It is foreseen that audible indication of contact would be an encouragement to the user, since it then would be apparent to the user that the desired exercise activity level is being maintained. Such indication could be in the form of a bell (not shown), or an electronically-generated tone.

Circuitry may be incorporated in the backplate and the stops to provide such electronic tones, and may include means to count the number of strikes of the bob 4 on the stops 6. The circuitry may include means to preselect a desired number of strikes so that a different tone may be generated when the count reaches the preset number to indicate that the duration of activity required has been reached.

A transparent cover may be provided totally enclosing the moving parts to prevent the pendulum from being obstructed by loose clothing.

In an alternative embodiment of the device, the swing of the pendulum may be modified by the use of progressive biasing which makes achievement of larger arcs of travel more difficult. For example, by biasing the pendulum bob 4 towards its rest position, the degree of activity required of the user will be increased for a given arc of swing. By way of example, magnetic repulsion between the pendulum bob and the stops may be used to provide such biasing and enhance the vigourousness of activity required.

In a further alternative embodiment of the device, the pendulum means may be constituted by a ball or roller moving along a curved guide channel or tube. The guide channel or tube may be circular, part-circular, or elliptical in shape, or may be formed from two oppositely-inclined portions joined by a curve to form a "V" shape. Adjustable stops may be provided by forming transverse openings in the walls of the guide tube or channel and inserting pins therethrough to obstruct the channel and thereby limit the travel of the ball or roller. It is also foreseen that a straight guide may be used either horizontally or inclined, with a ball or roller being moved between end stops by its inertia during movement of the device.

While the device has been described with reference to the illustrated embodiment, it is to be understood that the device may take other physical configurations without departing from the scope of the invention. For example, the backplate may be elliptical, semicircular or polygonal and the pendulum bob need not be spherical. The device may itself be incorporated into a belt buckle.

I claim:

1. An exercise measuring device comprising a back plate, a pendulum means mounted to said back plate for movement along a predetermined path, two limit stops situated along said path to define the extent of permissible movement of said pendulum means between said limit stops, said limit stops being selectively positionable at respective ones of a plurality of points spaced along said path by cooperation of said limit stops with detent means spaced in the longitudinal direction of said path said limit stops comprise a sound producing means whereby when said pendulum contacts either of said stops a sound audible to the user is produced.

2. An exercise measuring device according to claim 1 and further comprising cover means, said cover means being operatively mounted to said back plate so as to at least partially enclose said path.

3. An exercise measuring device according to claim 2 wherein said limit stops are mounted between said back plate and said cover.

4. An exercise measuring device according to claim 2 wherein said detent means is formed in said cover.

5. An exercise measuring device according to claim 3 wherein said detent means is formed in said cover.

6. An exercise measuring device according to claim 1 wherein said predetermined path is of arcuate configuration, wherein said pendulum means comprises a pendulum bob pendulum arm and pivot means, and further comprising bearing means carried by said back plate, and wherein said pivot means engages and cooperates with said bearing means to thereby define said predetermined path.

7. An exercise measuring device according to claim 6 and further comprising cover means, said cover means being operatively mounted to said back plate so as to at least partially enclose said path, and second bearing means operatively carried by said cover means, and wherein said pivot means engages and cooperates with the first mentioned bearing means and said second bearing means to thereby define said predetermined path.

8. In an exercise measuring device having electrical circuit means for sensing the occurrence of a series of events and in response thereto creating a related sensory output to the user of said device as a measurement of the degree of exercise by said user, the improvement comprising a back plate, a pendulum means mounted to said back plate for movement along a predetermined path, two limit stops situated along said path to define the extent of permissible movement of said pendulum means between said limit stops being selectively positionable at respective ones of a plurality of points spaced along said path by cooperation of said limit stops with detent means spaced in the longitudinal direction of said path, wherein during use of said device said pendulum means is caused to strike said limit stops, and wherein each said strike of said pendulum means defines an event within said series of events.

9. The device of claim 8 wherein said improvement further comprises cover means, said cover means being operatively mounted to said back plate so as to at least partially enclose said path.

10. The device of claim 9 wherein said limit stops are mounted between said back plate and said cover.

11. The device of claim 9 wherein said detent means is formed in said cover.

12. The device of claim 10 wherein said detent means is formed in said cover.

* * * * *